US005161767A

United States Patent [19]

Hansen

[11] Patent Number: 5,161,767

[45] Date of Patent: Nov. 10, 1992

[54] DRAFT/COPY HOLDER

[76] Inventor: Per R. Hansen, Ehlersvej 4H, DK-2900 Hellerup, Denmark

[21] Appl. No.: 655,385

[22] PCT Filed: Aug. 8, 1989

[86] PCT No.: PCT/DK89/00188

§ 371 Date: Mar. 25, 1991

§ 102(e) Date: Mar. 25, 1991

[87] PCT Pub. No.: WO90/01422

PCT Pub. Date: Feb. 22, 1990

[30] Foreign Application Priority Data

Aug. 9, 1988 [DK] Denmark ..... 4456

[51] Int. Cl.[5] ..... A47B 97/02; A47F 37/14

[52] U.S. Cl. ..... 248/447.1; 248/444.1; 248/442.2

[58] Field of Search ..... 248/447.1, 442.2, 444.1, 248/205.2, 451, 452; 312/233

[56] References Cited

U.S. PATENT DOCUMENTS

| | | | |
|---|---|---|---|
| 4,475,705 | 10/1984 | Hennenberg | 248/442.2 |
| 4,632,471 | 12/1986 | Visnapuu | 248/442.2 |
| 4,767,093 | 8/1988 | Jones | 248/447.1 |
| 4,893,775 | 1/1990 | Long | 248/442.2 |
| 4,902,078 | 2/1990 | Judd | 248/442.2 |

*Primary Examiner*—Reinaldo P. Machado
*Attorney, Agent, or Firm*—Antonelli, Terry, Stout & Kraus

[57] ABSTRACT

A draft/copy holder including a plate shaped draft/-copy holding arrangement with a fastener arrangement adapted to enable a fastening of the draft/copy holder on a support and carrying device. A portion of the plate is bent through an oblique angle so as to produce a side edge of the draft/copy holder, with the angle being preferably less than 90° and with an angular range extending between 40° and 75°. A detachable locking arrangement is provided on the bent portion of the draft/copy holder, with the locking arrangement being adapted to grip into correspondingly shaped locking arrangements provided on the support and carrying device.

10 Claims, 3 Drawing Sheets

DRAFT/COPY HOLDER

FIELD OF THE INVENTION

The present invention relates to a draft/copy holder including a plate-shaped draft/copy holder and means on the holder adapted to fasten the draft/copy holder to a support and carrying means.

BACKGROUND OF THE INVENTION

Draft/copy holders are known in many variations such as, for example, music stands wherein a holding means of the draft/copy holder is, for example, a pivotable arm linked, bearing connected, or through a screw pinching device connectible with a support and carrying means such as, for example, a table, a bookshelf, a board of the like.

If such a pivotable arm, possibly in the shape of a tong mechanism, must be installed at, for example, a computer CRT console or display screen such as at a keyboard arranged below such screen console, it has been found that it can be difficult to position the holding means at a suitable support and carrying means without the connecting means creating an obstacle for one or more of the accessory devices, occupying valuable table space of the work table, or hindering proper viewing of the printing device, etc. Experience also shows that, due to the differences existing in light intensity as absorbed between an internally illuminated display screen and the observed elimination of the operating devices around the display screen including also light from the surroundings, namely, full daylight or artificial illumination, for example, without the presence of daylight, the arranging of the operating devices at a work station is a very critical matter since, for example, consideration must be given to operators of the work station with respect to an ergonomical point of view, such as, for example, the height of the devices above the floor, the allowing for reasonable with-in-reach distances to the individual devices as well as usable with-in-sight distances playing a fundamental role by any practical use of the work station.

Draft/copy holders have been proposed which are adapted to be arranged in the range between the lower front edge of the display screens, between the front edge of carrying boards for such display screens, and a keyboard arranged below. This solution has certain advantages; however, a disadvantage resides in the fact that the eye must be physically moved between the draft/copy and the display screen in such a manner that it is necessary to simultaneously accurately remember which lines have been reached as viewed in the two visual directions, or, in case of graphical presentations, remembering which locations or spots are compared by watching, etc., that is, there are two versions to remember, that of the display screen and that of the draft/-copy.

SUMMARY OF THE INVENTION

The aim underlying the present invention essentially resides in providing a draft/copy holder of the above mentioned type by which, on the one hand, an easy installation and possibly a fast removal of the draft/-copy holder for one reason or another is possible and, on the other hand, a fast comparison between the contents of the display screen and the draft/copy is achieved, with the draft/copy holder being inexpensive to manufacture.

Advantageously, the draft/copy holder of the present invention can easily carry, for example, data lists, either in loose shape or data lists which remain attached to a printer.

In accordance with advantageous features of the present invention, the plate of the draft/copy holder is shaped larger than required due to the expected sizes of the draft/copies, and, an oversized portion of the plate, through an oblique bending, namely, a side edge of the plate shaped draft/copy is bent in a rearward direction through an angle which is preferably less than 90°. A bending angle of 60° is, in practice, a suitable angle size, and the front of the bent portion is at one or more locations fitted with a detachable locking arrangement adapted to grip correspondingly shaped locking arrangements arranged on the carrying and support means. Suitable locking arrangements may, for example, be fashioned of VELCRO strips, ribbons or the like. Such locking arrangements are suitable for attaching and detaching many times without being damaged and also exhibit a sufficiently strong holding or mounting power.

By virtue of the features of the present invention, a draft/copy holder is provided which is adapted to be mounted without further operations other than that of gluing such VELCRO type ribbons or strips, for example, in situ to the side wall of a display screen cabinet. A location or location range of such a type of cabinet for a comfortable fastening of the draft/copy holder onto the screen is easily determined, and, comfortable comparisons of the contents of the data lists, when viewed on the draft/copy on the holder, and the contents of the screen are facilitated. Furthermore, a data list arriving from a printer can easily be bent over an upper edge of the draft/copy holder, so that comparisons of the contents of the data list and the display screen can also be facilitated, and it can also be frequently carried out while the printer may be adding further print outs on the data list of text or graphics.

In accordance with further features of the present invention, the draft/copy holder may be constructed such that the holder, where the rearward bent portion of the plate is pressed in shape, is convex shaped with the convexity turned against the supporting and carrying means, that is, toward, for example, a carrying side wall of a display screen cabinet. In this manner not only an up-down tilting of the draft/copy holder may take place within a certain range which is determined, for example, by the size of the VELCRO strips or ribbons, or where also the tipped angle towards the side wall surface of the cabinet is made adaptable within a certain angle range, so that the draft/copy holder may be suitably mounted on oriented in relation to the horizontal directions with the display screen cabinets having very oblique or curved shaped side wall surfaces.

BRIEF DESCRIPTION OF THE DRAWINGS

Embodiments according to the invention are described in fuller detail in connection with the accompanying drawings wherein:

As shown in FIG. 2, the ribbons 4A, 4B, 4C and 4D may be arranged in an X pattern, with the strips 4A, 4D and 4B, 4C being unitary with the strip 4 as shown in phantom line or arranged as individual ribbons as shown in the drawing.

Figure 1:
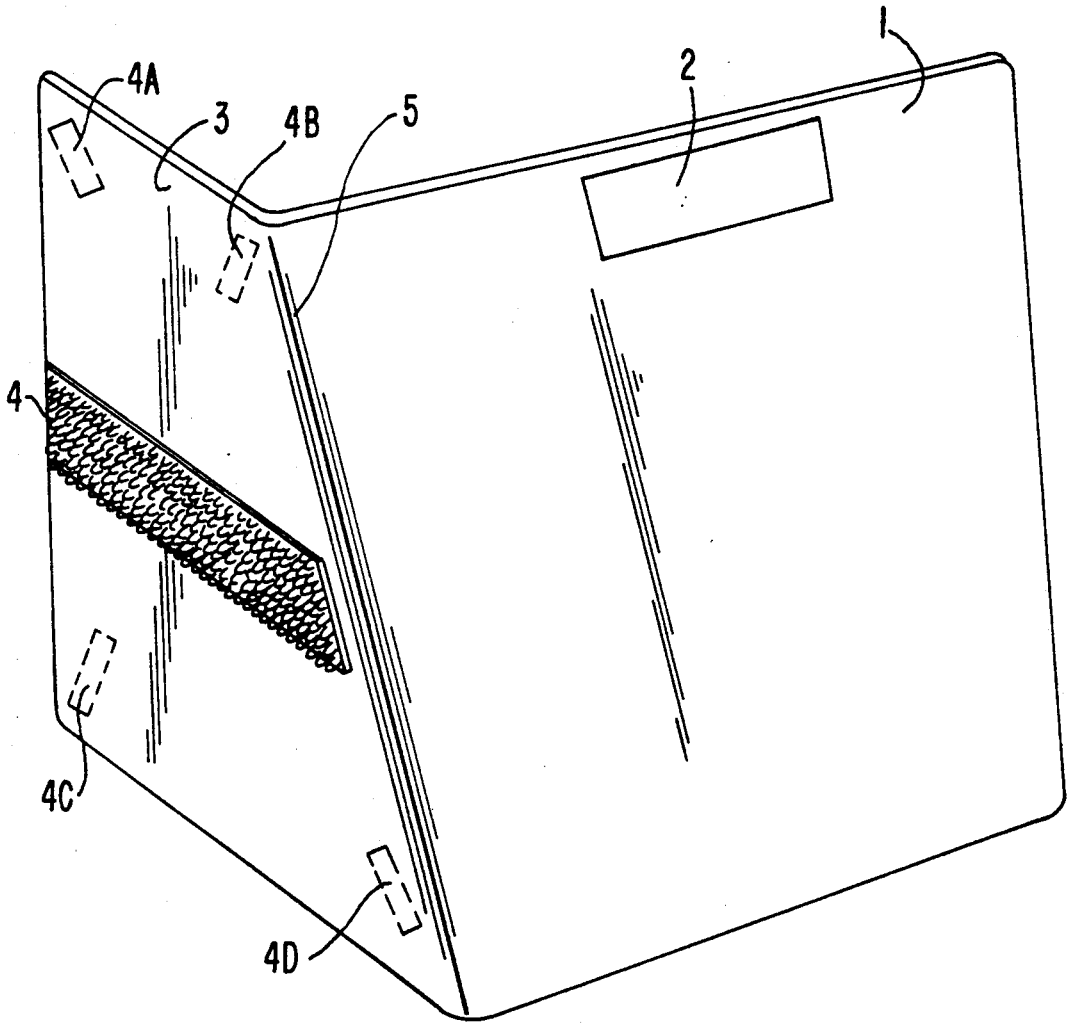
FIGS. 1 and 2 are perspective views of alternate embodiments of a draft/copy holder according to the invention.
Figure 2:
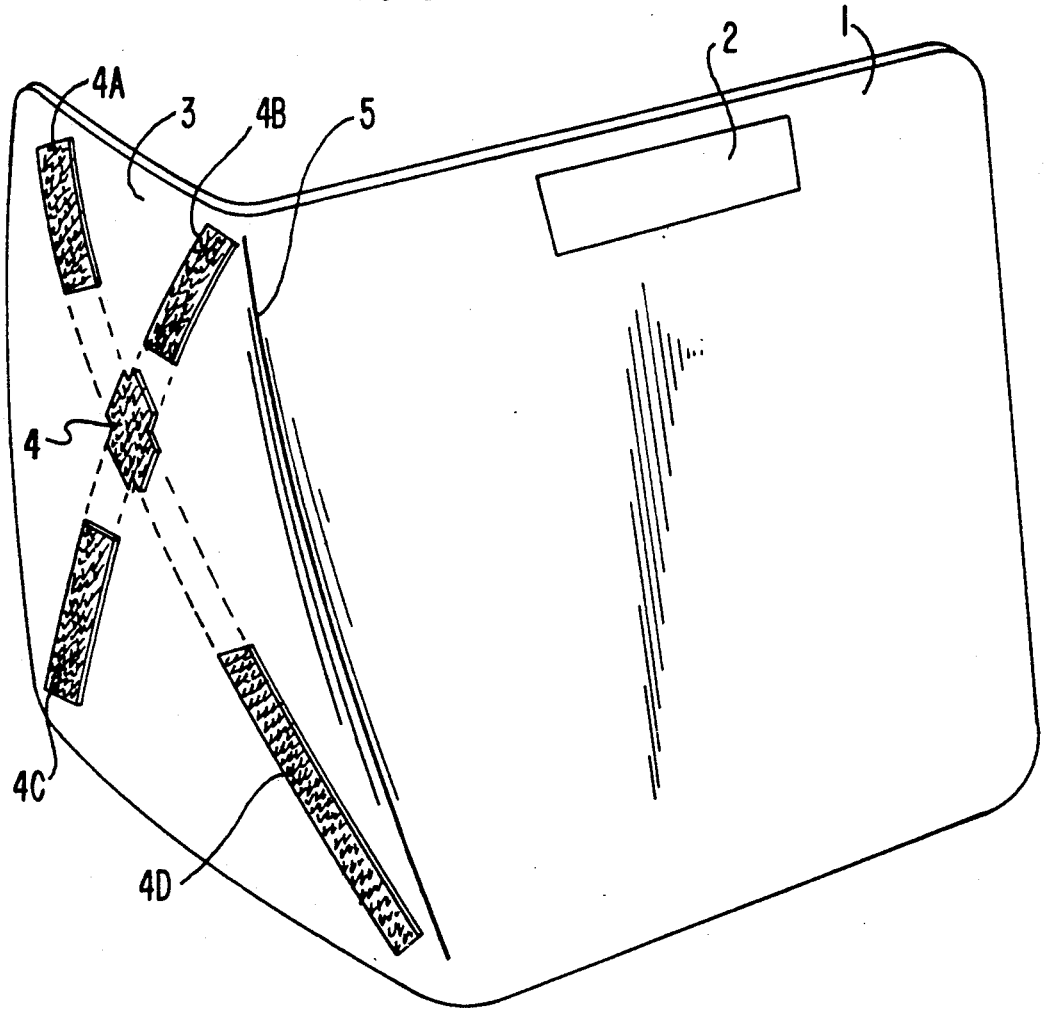
Figure 3:
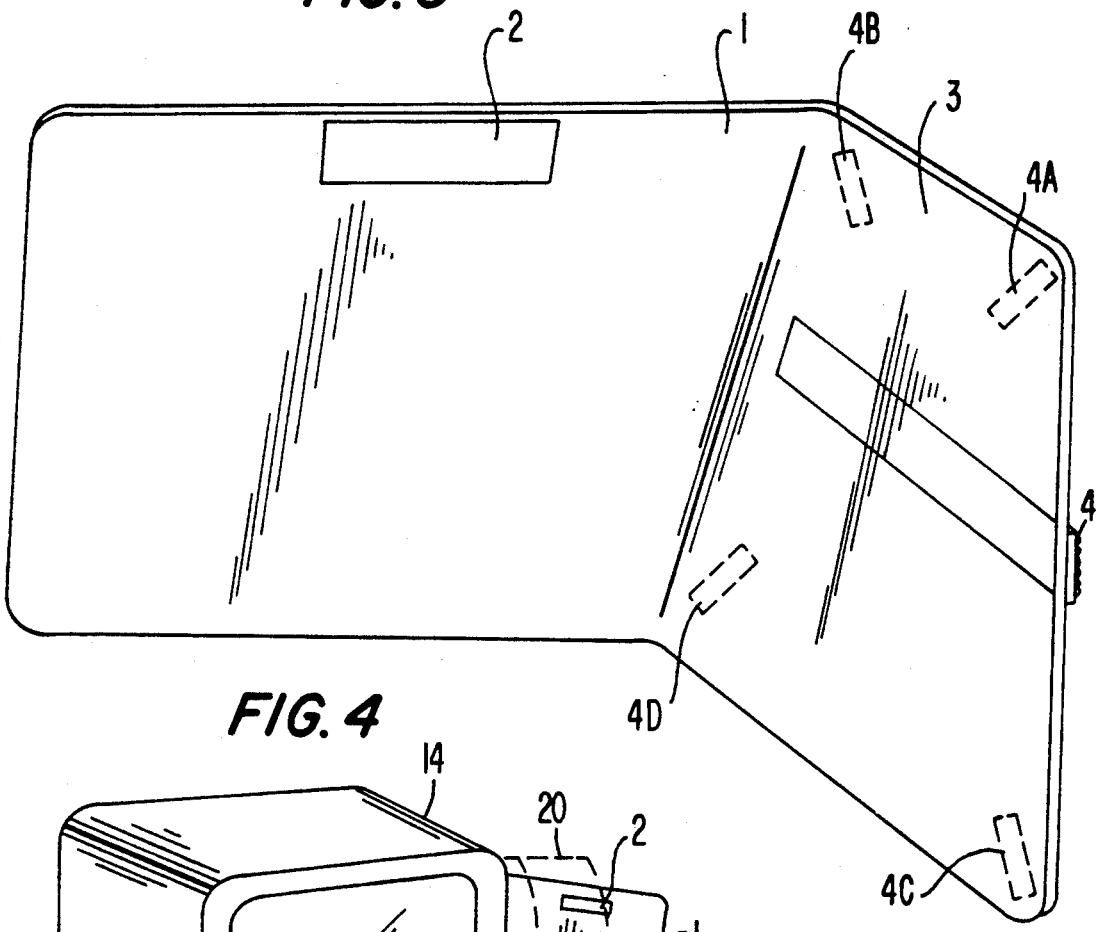
FIG. 3 is a perspective rear view of the draft/copy holder of FIG. 1.
Figure 4:
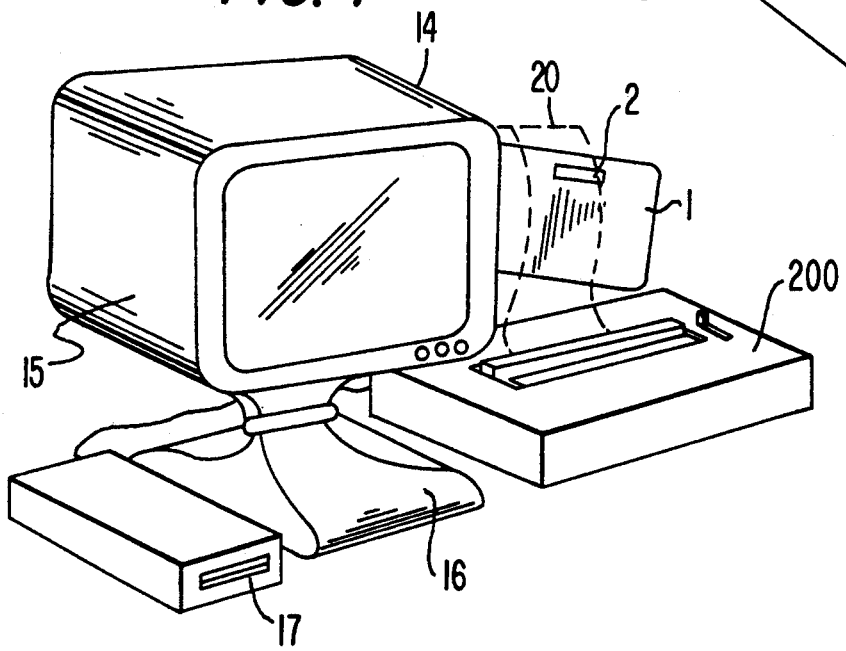
FIG. 4 is a perspective view of a display screen operating station including a display screen on a side of which a draft/copy holder of the present invention is mounted by a VELCRO locking arrangement Referring now to the drawings wherein like reference numerals are used throughout the various views to designate like parts and, more particularly, to FIGS. 1 and 3, according to these figures, a draft copy holder according to the present invention comprises a plate shaped draft/copy holder 1 combined with a clip or double sided adhesive tape 2, for fastening, for example, a draft or copy (not shown) to the plate shaped draft/-copy holder 1. A plate portion 3 is, by an oblique fold 5 folded rearwardly with respect to the plate shaped draft/copy holder 1. The plate portion 3 comprises a suitable locking arrangement fashioned, for example, as a clip fastening means (not shown) or VELCRO ribbons 4, only one of which is shown in FIG. 1 of the drawings. However, in practice, more than one ribbon 4 could be provided. Thus, further locking arrangements such as, for example, ribbons 4A, 4B, 4C and 4D may, as shown in FIG. 2, be provided. All of the ribbons 4, 4A, 4B, and 4C are adapted to grip into one or more corresponding locking means provided on a side wall of a supporting or carrying means such as, for example, a cabinet of a display screen 15 (FIG. 4).

By virtue of the convex shape of the plate portion 3 in a direction toward the supporting and carrying means, the entire draft/copy holder 1 is oblique with respect to a convex curved shaped side wall of a supporting or carrying means or with respect to a plane surfaced side wall of a supporting and carrying means FIG. 4 provides an example of a typical work station comprising a display screen 15, with the draft/copy holder of FIGS. 1-3 being fastened to a side wall 14 of the cabinet of the display screen 15. Below the draft/-copy holder, a printer 200, for example, can be placed, from which a data list 20, shown in phantom line, can be lead over the draft/copy holder, just as other types of drafts or copies may be simultaneously maintained in place or, alternatively, by the draft/copy holder 1. The computer screen 15 is shown mounted on a conventional tiltable base device 16. It is evident that through the possible change of the tilt angle of the device according to the invention, the position of fastening of the draft/copy holder to the side wall 14 of the display screen 15 may be corrected. For the sake of completeness, the work station, as shown in the drawing, includes a disc drive 17.

I claim:

1. A draft/copy holder comprising:

a plate shaped draft/copy holding means;

means adapted to fasten the plate shaped draft/copy holding means to a lateral side support and carrying means, wherein said draft/copy holding means includes a first plate shaped portion, and a second plate portion formed in one piece with said first plate portion, and wherein said second plate portion is bent with respect to said first plate portion at an angle of less than 90°.

2. A draft/copy holder according to claim 1, wherein the angle is in a range between 40° and 75°.

3. A draft/copy holder according to one of claims 1 or 2, wherein the second plate portion is bent in a rearward direction of the first plate portion.

4. A draft/copy holder according to claim 3, wherein a detachable locking means adapted to grip a correspondingly shaped locking means arranged on the carrying and supporting means is provided on at least one portion of a front surface of said second plate portion.

5. A draft/copy holder according to claim 4, wherein the detachable locking means includes at least one set of locking ribbons adhesively mounted on at least one of the draft/copy holder and the support and carrying means.

6. A draft/copy holder according to claim 5, wherein the second plate portion has a shape corresponding to a shape of a fastening surface on the support and carrying means to which the draft/copy holder is fastened.

7. A draft/copy holder according to one of claims 1 or 2, wherein a detachable locking means adapted to grip a correspondingly shaped locking means arranged on the carrying and support means is provided on at least one portion of a front surface of the second plate portion.

8. A draft/copy holder according to claim 7, wherein the locking means includes at least one set of locking ribbons adhesively mounted on at least one of the draft/copy holder and the support and carrying means.

9. A draft/copy holder according to claim 8, wherein the second plate portion has a shape corresponding to a shape of a fastening surface on the support and carrying means to which the draft/copy holder is fastened.

10. A draft/copy holder according to one of claims 1 or 2, wherein the second plate portion has a shape corresponding to a shape of a fastening surface on the support and carrying means to which the draft/copy holder is fastened.

* * * * *